US006056144A

United States Patent [19]

Strange et al.

[11] Patent Number: 6,056,144

[45] Date of Patent: May 2, 2000

[54] BEVERAGE CUP WITH LOCKING LID

[75] Inventors: Randall H. Strange, Lebanon; David E. Stier, Loveland; Ernest Lindlar, Cincinnati, all of Ohio

[73] Assignee: International Paper Co., Purchase, N.Y.

[21] Appl. No.: 09/086,425

[22] Filed: May 28, 1998

Related U.S. Application Data

[60] Provisional application No. 60/048,089, May 30, 1997.

[51] Int. Cl.[7] ..... B65D 41/06

[52] U.S. Cl. ..... 220/297; 220/784; 220/788; 220/709

[58] Field of Search ..... 220/293, 297, 220/298, 781, 784, 786, 788, 792, 709, 705, 703, 711, FOR 100, FOR 102; 215/222, 224, 225, 317, 318, 321, 332, 337

[56] References Cited

U.S. PATENT DOCUMENTS

| | | | |
|---|---|---|---|
| 183,890 | 10/1876 | Block . | |
| 826,796 | 7/1906 | McMangs . | |
| 1,611,443 | 12/1926 | Hothersall | 215/332 |
| 2,257,919 | 10/1941 | Rutkowski | 220/304 X |
| 2,281,649 | 5/1942 | Williams . | |
| 2,849,146 | 8/1958 | Wigert . | |
| 2,879,935 | 3/1959 | Carter . | |
| 3,065,875 | 11/1962 | Negoro | 220/784 |
| 3,812,989 | 5/1974 | Horvath . | |
| 4,026,459 | 5/1977 | Blanchard . | |
| 4,202,462 | 5/1980 | Imber . | |
| 4,421,244 | 12/1983 | Van Melle | 220/781 |
| 5,161,706 | 11/1992 | Weinstein | 215/225 X |
| 5,351,845 | 10/1994 | Hunter | 215/225 |

FOREIGN PATENT DOCUMENTS

| | | | |
|---|---|---|---|
| 1109419 | 9/1981 | Canada | 220/100 |
| 2529903 | 12/1983 | France | 220/100 |
| 508013 | 1/1955 | Italy | 215/332 |
| 1333749 | 10/1973 | United Kingdom | 215/224 |
| 2008550 | 6/1979 | United Kingdom | 215/332 |

*Primary Examiner*—Nathan Newhouse
*Attorney, Agent, or Firm*—Ralph J. Skinkiss

[57] ABSTRACT

A beverage container lid is disclosed and taught whereby the brim of the lid is provided a multiplicity of small inwardly directed, radial protuberances projecting inward from the lid's outer peripheral brim which snap-in place under the cup's beaded rim thereby securing the lid to the cup's rim. In addition the circumferential array of small protuberances is interrupted by one or more, preferably three, inwardly projecting, circumferentially elongated oblong protuberances which engage the under surface of the cup's circumferential beaded rim. A second embodiment the beaded rim of the beverage cup is also taught wherein circumferentially spaced depressions, or recesses, corresponding to the oblong protuberances of the lid are provided. When the lid is applied to the cup, the oblong protuberances are indexed so as to pass over the rim depressions. After the lid is in place, the lid is rotated, with respect to the cup, thereby placing the oblong protuberances under the cup's, otherwise undisturbed circumferential rim bead, thereby securely locking the lid in place.

5 Claims, 8 Drawing Sheets

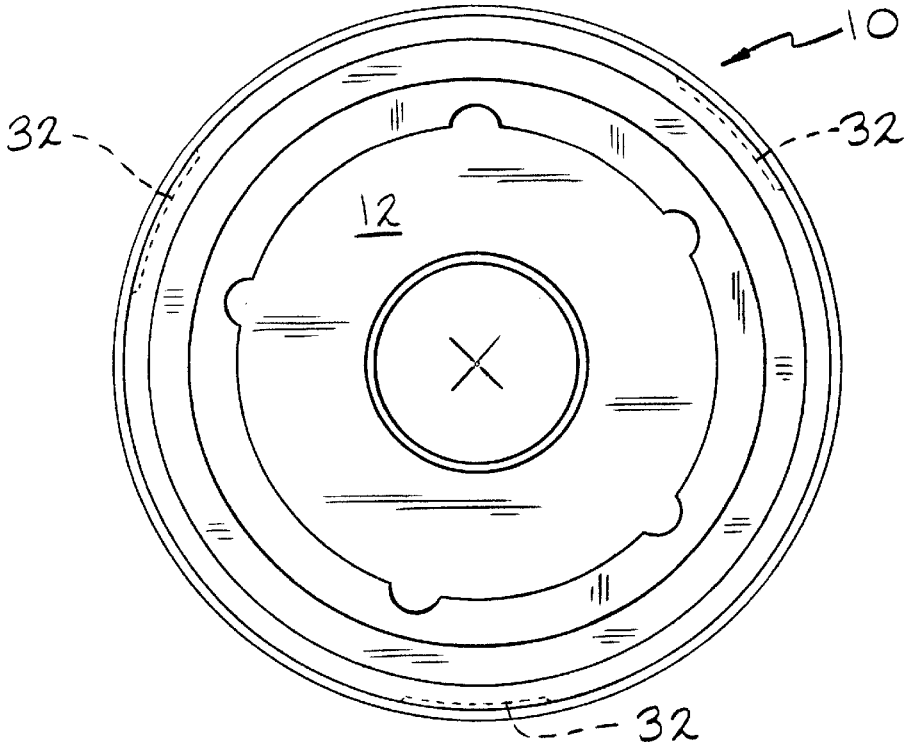
FIG. 3
FIG. 4
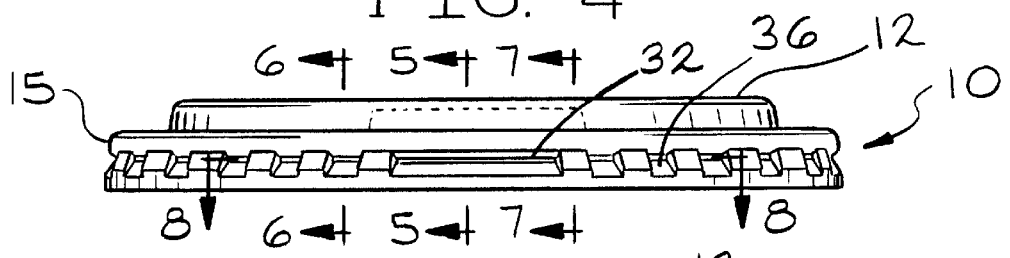
FIG. 5
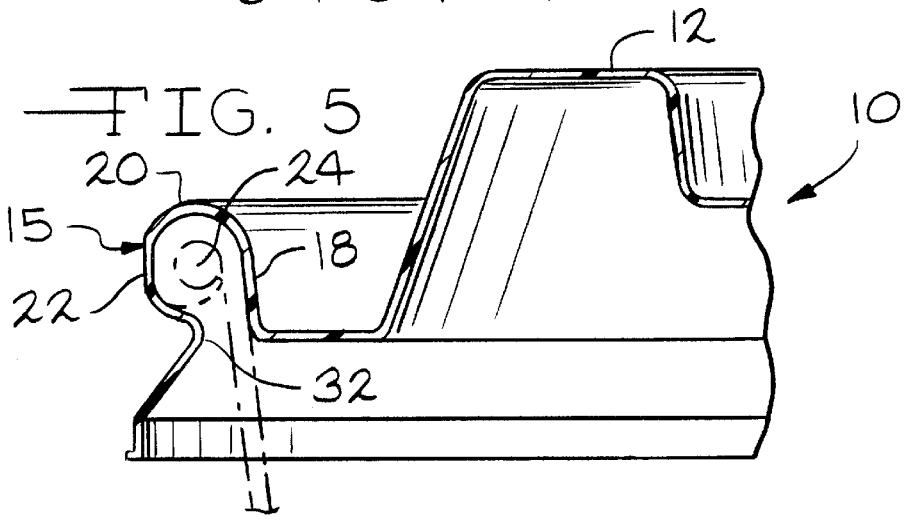

FIG. 12
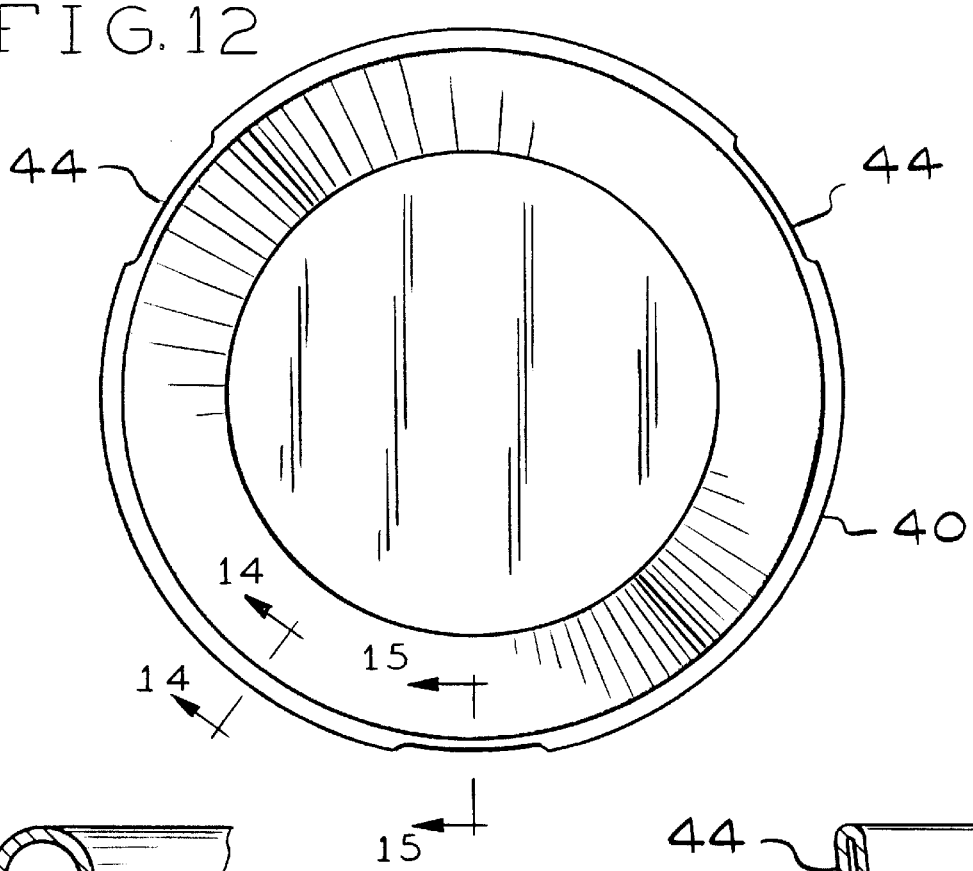
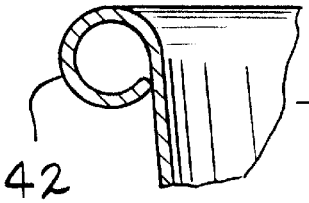
FIG. 14
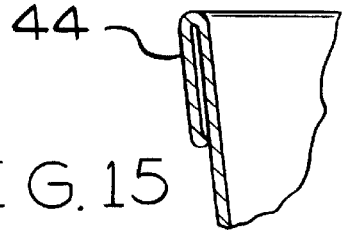
FIG. 15
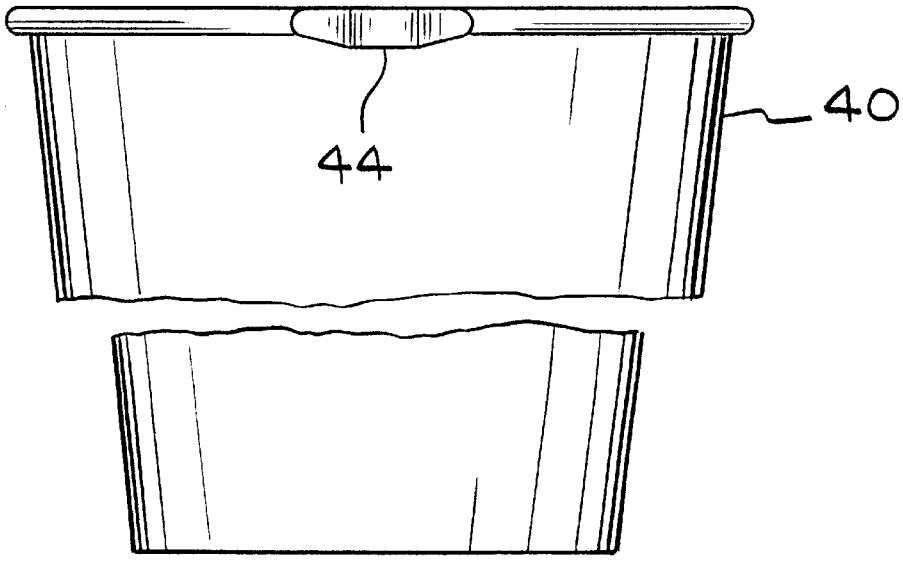
FIG. 13

FIG. 18
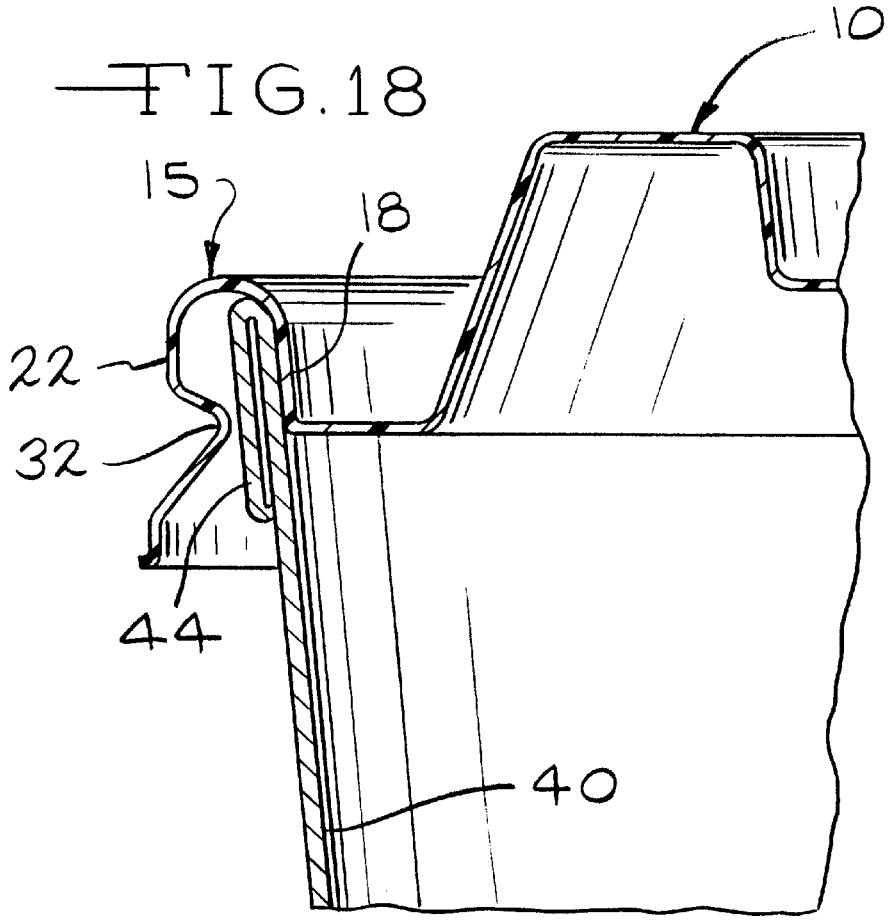
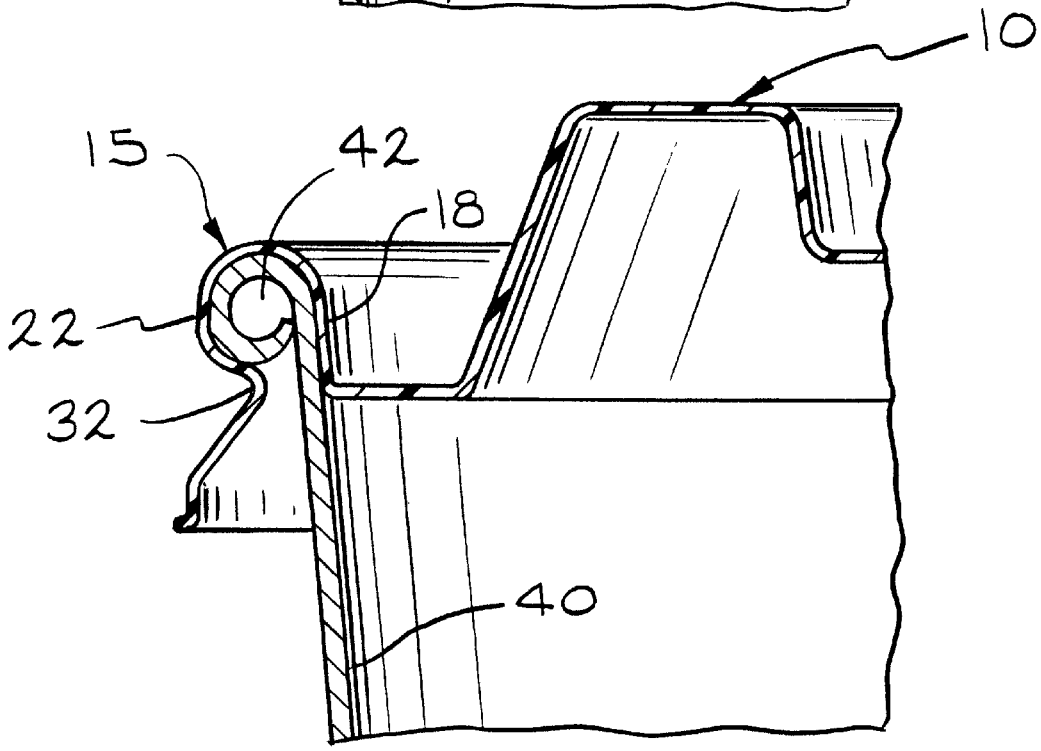
FIG. 19

BEVERAGE CUP WITH LOCKING LID

RELATED APPLICATIONS

This application is a continuation of Provisional Application Ser. No. 60/048,089, filed on May 30, 1997.

BACKGROUND OF THE INVENTION

The present invention relates to a disposable plastic closure or lid, designed for use in connection with paper and/or plastic containers of various types such as beverage cups, food tubs and the like as commonly used in the fast food industry. Many such closures have been provided by the prior art with a wide variety of techniques for effecting engagement of the lid with the container. Notwithstanding the provisions of the prior art, a need remains for a method and apparatus for securing container lids to the container whereby the lid will remain attached to the container when deformed and in the event the container is inadvertently tipped over or otherwise tumbles onto a solid surface. Such a secured lid is particularly needed in the fast food industry for serving liquid beverages.

SUMMARY OF THE PRESENT INVENTION

By the present invention, a beverage container lid is disclosed and taught whereby the brim of the lid is provided a multiplicity of small inwardly directed, radial protuberances projecting inward from the lid's outer peripheral brim which snap-in place under the cup's beaded rim thereby securing the lid to the cup's rim. In addition the circumferential array of small protuberances is interrupted by one or more, preferably three, inwardly projecting, circumferentially elongated oblong protuberances which engage the under surface of the cup's circumferential beaded rim. Preferably the oblong protuberances extend radially inward beyond the locus of the smaller protuberances. In addition, it is also preferable that the plug section of the lid's peripheral brim be deep enough that so that the inner wall of the plug section extends downward into the cup portion below the cup rim whereby a locking relationship is created between the lid's plug section and the cup's rim.

In a second embodiment, of the above described invention, the beaded rim of the beverage cup includes circumferentially spaced depressions, or recesses, corresponding to the oblong protuberances of the lid. When the lid is applied to the cup, the oblong protuberances are indexed so as to pass over the rim depressions. After the lid is in place, the lid is rotated, with respect to the cup, thereby placing the oblong protuberances under the cup's, otherwise undisturbed circumferential rim bead, thereby securely locking the lid in place. To remove the lid, the lid is reversibly rotated to again align the oblong protuberances with the rim depressions thereby permitting the lid to be removed. In this second embodiment the lid may be provided with or without the circumferential array of smaller protuberances between the oblong protuberances.

BRIEF DESCRIPTION OF THE DRAWINGS

FIG. 3 illustrates a top plan view of a plastic beverage cup lid embodying the present invention.

FIG. 4 presents a side elevational view of the beverage cup lid illustrated in FIG. 1.

FIG. 5 presents a crossectional view taken along line 5—5 in FIG. 4.

FIG. 12 presents a top view of a cup embodying an alternate embodiment of the present invention.

FIG. 13 presents a side elevational view of the cup illustrated in FIG. 12.

FIG. 14 present a crossectional view taken along line 14—14 in FIG. 12.

FIG. 15 presents a crossectional view taken along line 15—15 in FIG. 12.

FIG. 18 presents a crossectional view taken along line 18—18 in FIG. 17.

FIG. 19 presents a crossectional view, similar to that of FIG. 18, wherein the beverage cup lid has been rotated with respect to the cup.

Figure 1:
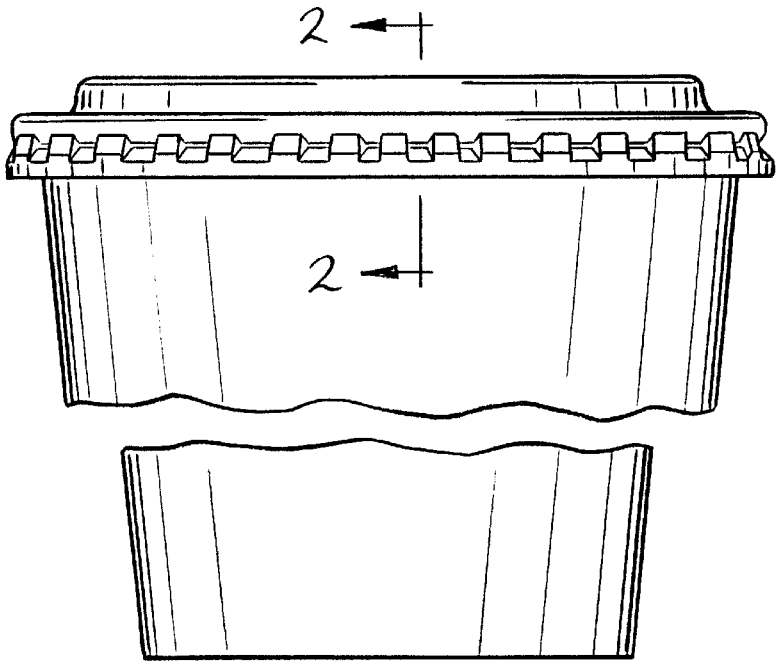
FIG. 1 PRIOR ART
FIGS. 1 and 2 illustrate the typical prior art method for attaching a plastic lid to a beverage cup as typically used in the fast food industry.
Figure 2:
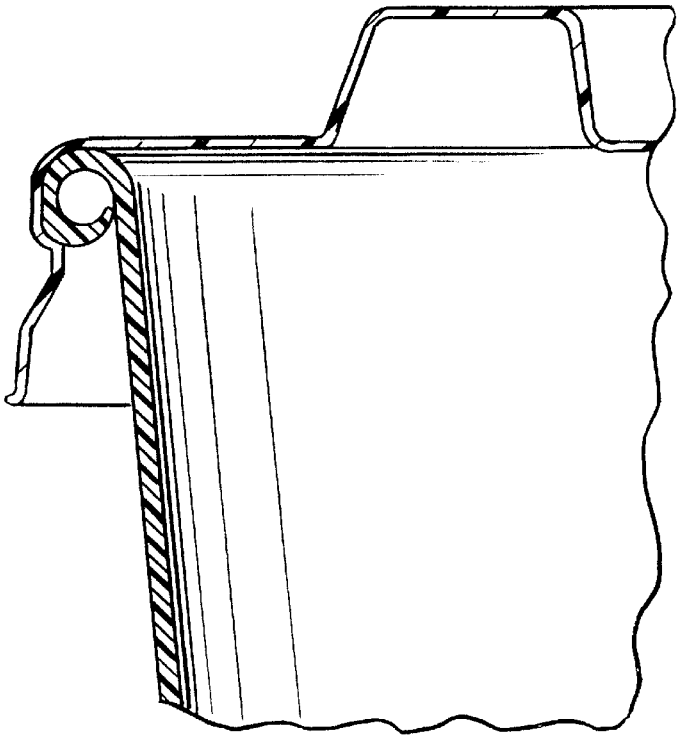
FIG. 2 PRIOR ART

DETAILED DESCRIPTION OF THE INVENTION a) First Embodiment:

Referring first to FIGS. 1 and 2, wherein a typical prior art beverage cup and lid assembly is illustrated. Prior art lids typically comprise a brim having a multiplicity of small inwardly, radial, projections which snap inwardly under the cup's rolled over beaded rim thereby attaching the lid to the cup as best illustrated in FIG. 2. However, because of the general flexibility of the cup rim, and the poor penetration of the projections under the rim, the projections inherently become dislodged from the cup rim whenever the cup's rim is slightly deformed into a configuration other than the desired circle. Once one or more of the prior art projections become dislodged from the cup's beaded rim, adjacent projections also tend to release from the cup's beaded rim in a "chain reaction" type of sequence thereby resulting in separation of cup and lid. Such action occurs, for example, when the prior art cup-lid assembly is accidentally tipped over or tumbles from a moderate height onto a solid surface thus resulting in spillage of the cup contents.

Referring now to FIGS. 3 through 8, a disposable cup lid 10, embodying the present invention, is illustrated. Lid 10 is typically compression molded, or stamped, from flat plastic stock in a matched metal die by a process well known in the industry and will not be further described herein.

Figure 6:
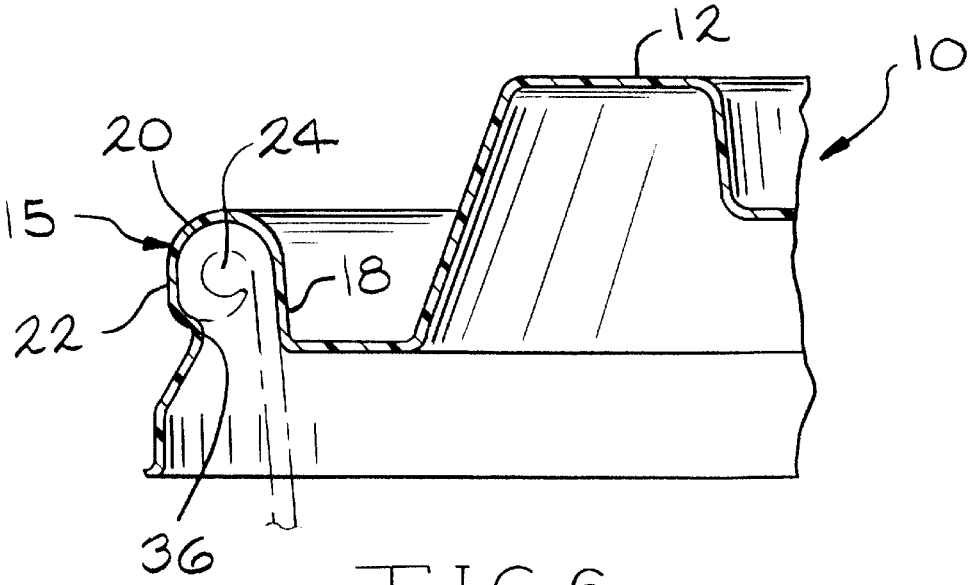
FIG. 6 present a crossectional view taken along line 6—6 in FIG. 4.
Figure 7:
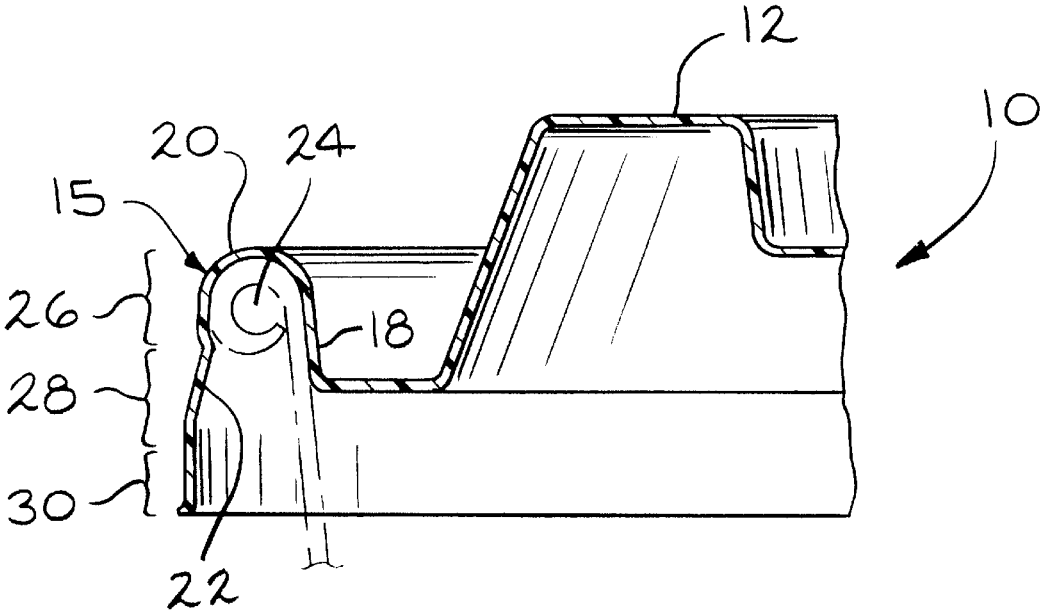
FIG. 7 presents a crossectional view taken along line 7—7 in FIG. 4.
Figure 11:
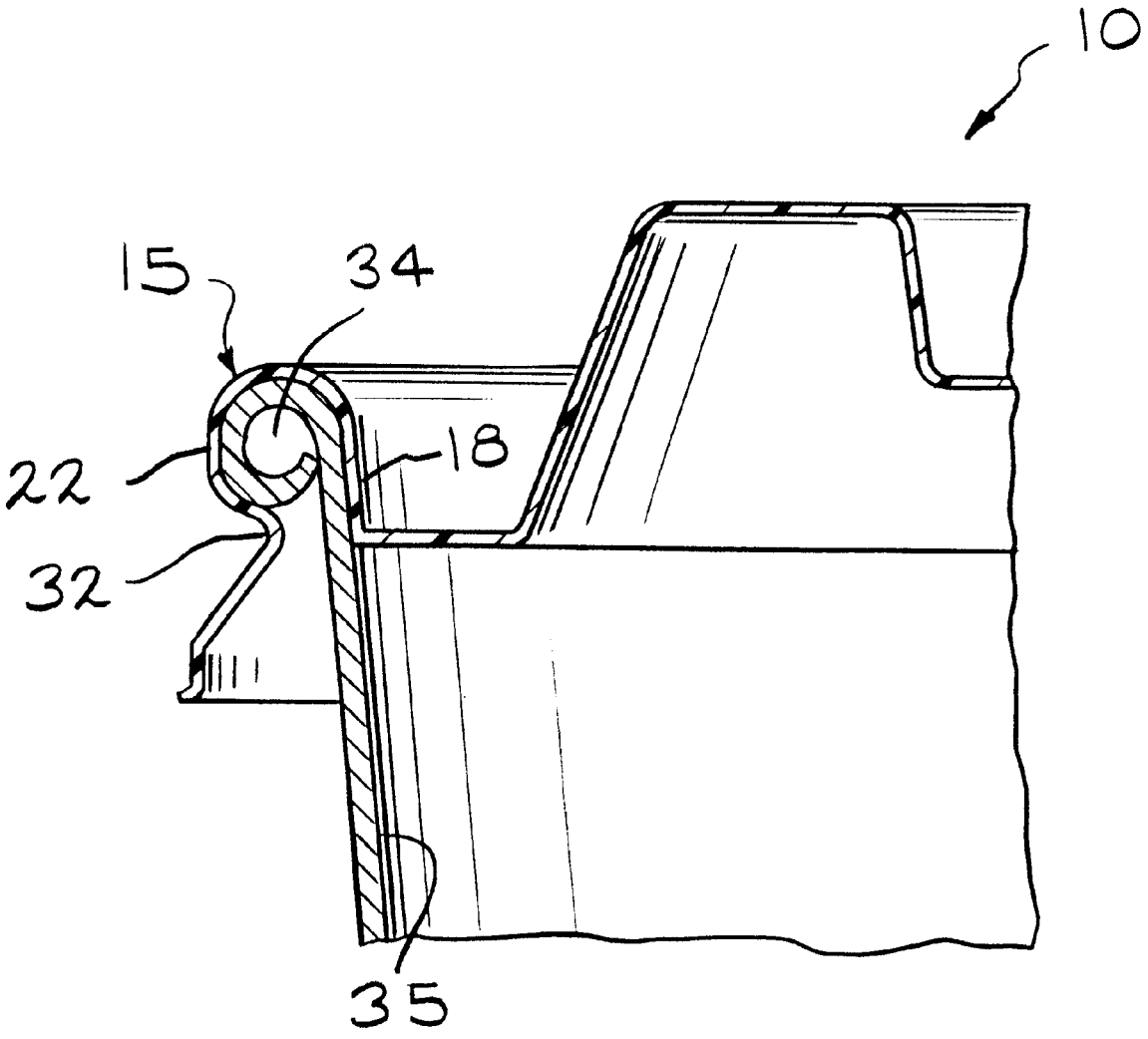
FIG. 11 presents a crossectional view taken along line 11—11 in FIG. 10.

Lid 10 generally comprises a central dome portion 12 extending across the major portion of the lids over all diameter. Dome 12 may have any number of configurations suitable, or otherwise common within the disposable cup industry and does not necessarily represent a significant portion of the present invention. Circumscribing dome 12 is brim 15 typically comprising an inside wall 18, a top wall 20, and an outside wall 22. Both inside wall 18 and outside wall 22 generally comprise cylindrical surfaces, as illustrated in FIGS. 5, 6, and 7. Top wall 20 generally comprises a semicircular cross section and in cooperation with inside and outside walls 18 and 22 forms an annular, downwardly opening, "plug type," cavity 24 for receiving therein, in a locking or gripping relationship, the beaded rim of a typical disposal beverage cup as illustrated in FIG. 11. Beaded rim 24 is preferably received tightly within the plug cavity 24 receiving applied pressure from walls 18, 20, and 22 with the inner wall 18 extending substantially below the beaded rim of the cup.

Figure 8:
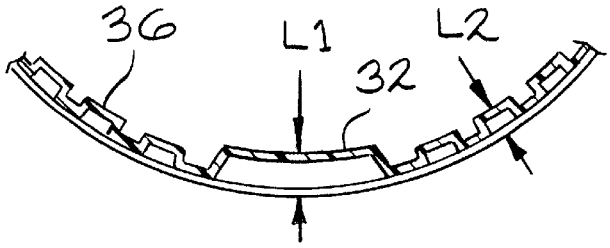
FIG. 8 presents a crossectional view taken along line 8—8 in FIG. 4.

As illustrated in the FIG. 7, outside wall 22 further comprises an upper band 26, an intermediate band 28, and a lower band 30. Referring to FIGS. 4 through 8, intermediate band 28 includes a discontinuous inwardly directed, circumferential bead comprising three circumferentially oblong protuberances 32 with a multiplicity of circumferentially arrayed short protubernces 36 therebetween projecting radially inward from outside wall 22. The phrase "discontinuous bead" as used herein, is intended to define an array of circumferentially aligned protuberances, 32 and 36, which cooperate to form a segmented circumferential bead, as illustrated in FIG. 8, which will provide an interference or "snap-fit" characteristic to the lid.

As illustrated in FIG. 8, it is preferred that the radial length $L_1$, of protuberance 32, be slightly greater than the radial length $L_2$ of protuberance 36. Also the arc, or circumferential, length of protuberance 32 is preferably at least two times the arc length of protuberance 36. The exact dimensions being a result of empirical testing for the particular size of cup and associated lid. Although it is preferred that $L_1$ be greater than $L_2$ a lid having $L_1$ equal to $L_2$ is also within the scope of the present invention.

Although the preferred embodiment, as described herein, teaches three equally spaced oblong protuberances 32, the use of one, two or any number beyond 3 may also be used. Also it is within the scope of the present invention to position the oblong protuberances 32 at circumferential positions other than as equally spaced.

Figure 9:
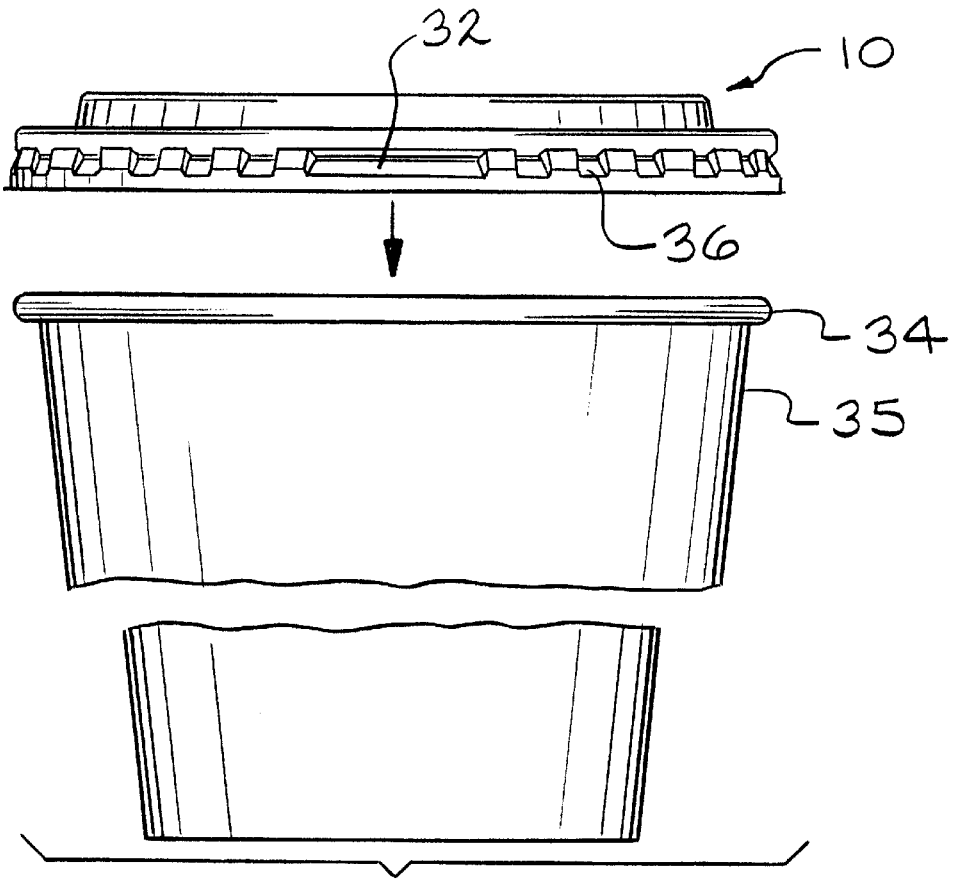
FIG. 9 presents a separated side elevational view of a beverage cup lid embodying the present invention and its associated cup.
Figure 10:
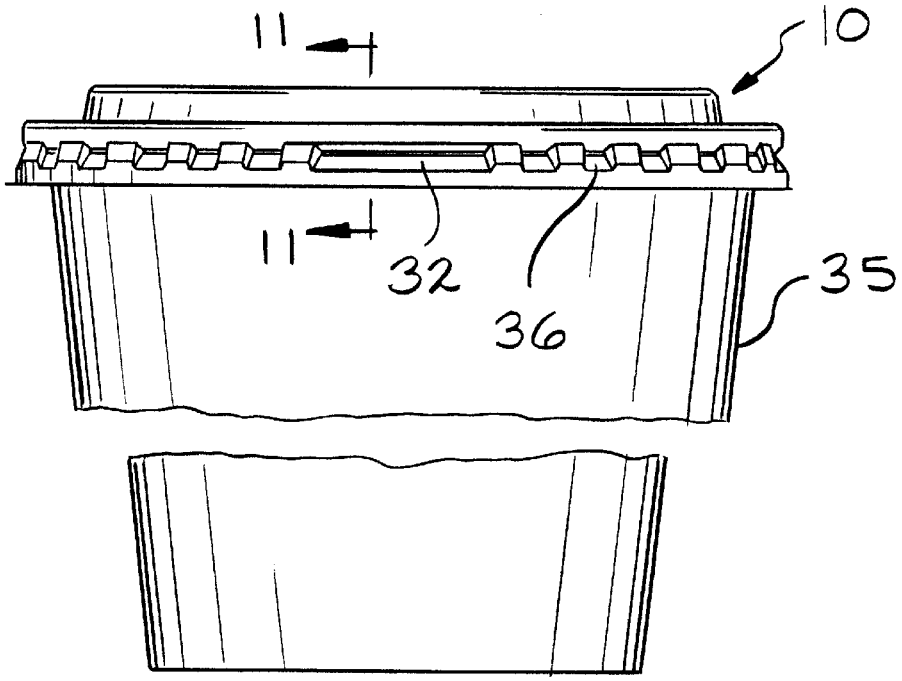
FIG. 10 presents a side elevational view of a beverage cup lid embodying the present invention attached to its associated cup.

FIGS. 9 through 11, illustrate a typical disposable beverage cup 35 and an associated lid 10 embodying the present invention. Lid 10 is typically positioned atop cup 35, as illustrated in FIG. 9, and pressed downward upon the beaded rim 34 as illustrated in FIG. 10. Protuberances 32 snaps in place under rim 34 as illustrated in FIG. 11. Similarly the smaller protuberances 36 also snap in place under lip 34 as can be appreciated by viewing FIG. 6 wherein a cup's beaded rim is shown in phantom.

Tests have shown that by providing the larger oblong protuberances 32, preferably three, in addition to the smaller protuberances 36 provides a very secure attachment of lid to cup rim is realized. The herein disclosed cup/lid structure successfully survives the typical impact experienced, by a cup full of liquid beverage, when the cup/lid assembly is tipped over and/or tumbles from a moderate height onto a solid surface without the lid separating from the cup.

Although the exact dynamics are not fully understood, it is believed that the presence of the larger protuberances 32 prevent the otherwise chain reaction separation of the smaller protuberances 36 when the cup/lid combination impacts the floor.

b) Second Embodiment:

Referring now to FIGS. 12 through 19, a second embodiment, of the present invention, is illustrated wherein the cup/lid assembly includes a rotatable locking lid feature. Cup 40 includes a typical beaded rim 42 circumscribing the open end of the cup. At three equally spaced circumferential positions, bead 42 has been flattened, deformed, or otherwise diminished in its radial dimension, thereby providing three recessed slots, or depressions, 44 as best illustrated in FIGS. 12 through 15.

Figure 16:
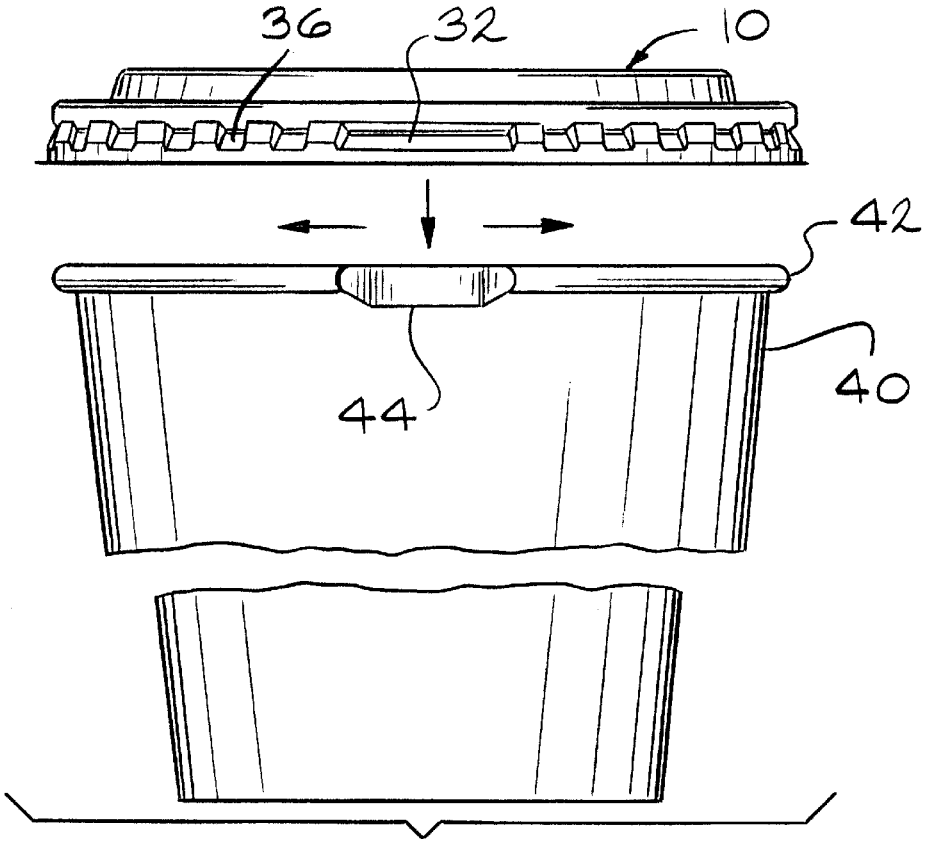
FIG. 16 presents a separated side elevational view of the beverage cup lid as illustrated in FIGS. 3 through 8 and the alternate embodiment cup as illustrated in FIGS. 12 through 15.
Figure 17:
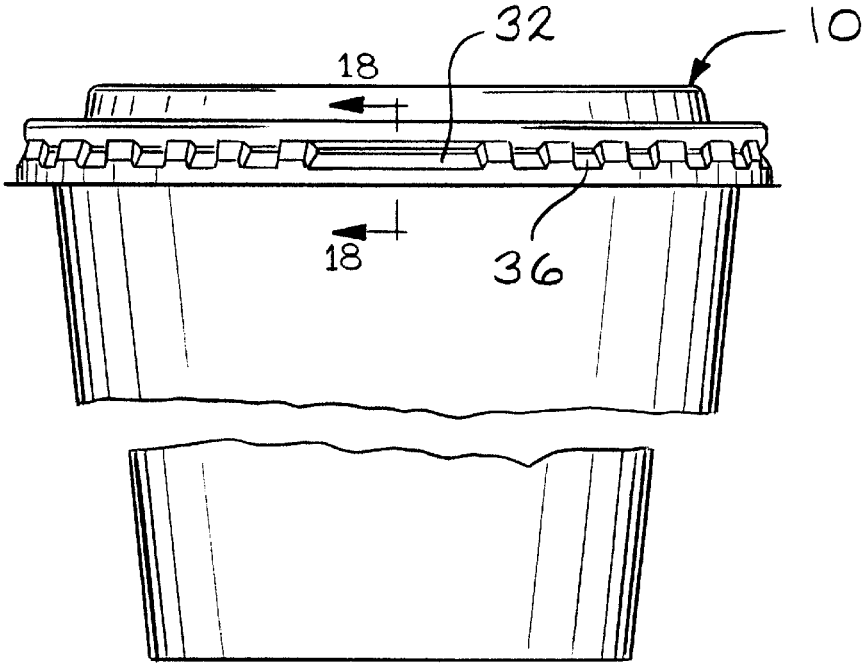
FIG. 17 presents a side elevational view of the cup and lid, as illustrated in FIG. 16, in their assembled state.

When lid 10 is placed atop cup 40, the oblong protuberances 32 are first aligned with the recessed slots 44 as illustrated in FIG. 16. As lid 10 is pressed downward upon cup 40 protuberances 32 pass downward within slots 44 as illustrated in FIG. 18. Lid 10 is then rotated, with relative to cup 40 such that oblong protuberances 32 are repositioned under the undisturbed portion of beaded rim 42, as illustrated in FIG. 19, thereby securing lid 10 to cup 40. To remove lid 10, the lid is merely rotated back to the position, as illustrated in FIG. 18, whereby the protuberances 32 are again aligned with recesses 44 and the lid removed.

Although the preferred embodiment is illustrated wherein both the short and oblong protuberances 36 and 32, of the first embodiment, are also present in the second embodiment it is also within the scope of the present invention to provide a lid 10 having only the oblong protuberances 32. Further, although the preferred embodiment is presented having three oblong protuberances 32, one may, within the scope of the present invention, provide a lid 10 having one, two or more oblong protuberances with corresponding recesses on the cup 's beaded rim 42. Still further it is also within the scope of the present invention to provide more recesses 44 than protuberances 32. For example, a lid may include three equally spaced oblong protuberances 32 may be provided each spaced 120 degrees apart and the corresponding cup may include six recesses 44 each spaced 60 degrees apart whereby the lid may be applied by aligning the three protuberances of the lid with any three aligned recesses.

In the foregoing drawings and specification, there is specifically disclosed only the preferred embodiments of the invention, though it will readily be realized that various modifications may be made without departing from the scope and spirit of the invention.

We claim:

1. In combination, a beverage cup and removable lid comprising:

a) a generally cylindrical shaped cup having an open top and an opposite closed bottom, said open top having a lid retaining bead circumscribing the open top thereof, said bead having at least two circumferentially extending recessed slots therein, b) a removable lid having a circumscribing brim, said brim including a first set of inwardly directed projections wherein each of said projections having a radially inward length of L, said first set of projections generally circumscribing the inward surface of said brim wherein said first set of projections circumferentially grip the bead of said cup, c) a second set of two radially inward projecting protuberances circumferentially aligned with the recessed slots of said lid retaining bead of said cup wherein each protuberance of said second set is aligned with one of said recessed slots of said cup bead, whereby said second set of protuberances will pass axially through said recessed slots of said lid retaining bead of said cup when said lid is affixed to said cup, said second set of protuberances having an inwardly directed radial length greater than L whereby said protuberance passes under the bead of said cup when said lid is affixed to said cup and rotated with respect to said cup.

2. The combination as claimed in claim 1 wherein said recessed slots are equally spaced about said lid retaining bead.

3. The combination as claimed in claim 1 wherein said at least two slots comprises three recessed slots are provided in said lid retaining bead of said cup and said second set of protuberances comprises three protuberances corresponding to said three recessed slots.

4. The combination as claimed in claim 3 wherein said three recessed slots in said lid retaining bead are equally spaced about said lid retaining bead.

5. In combination, a beverage cup and removable lid comprising:

a) a generally cylindrical shaped cup having an open top and an opposite closed bottom, said open top having a lid retaining bead circumscribing the open top thereof, said bead having one circumferentially extending recessed slot therein, b) a removable lid having a circumscribing brim, said brim including a first set of inwardly directed projections wherein each of said projections has a radially inward length of L, said first set of projections generally circumscribing the inward surface of said brim wherein said first set of projections circumferentially grip the bead of said cup, c) one radially inward projecting protuberance circumferentially aligned with the recessed slot of said lid retaining bead of said cup wherein said protuberance is aligned with said recessed slot of said cup bead whereby said protuberance will pass axially through said recessed slot of said lid retaining bead of said cup when said lid is affixed to said cup, said protuberance having an inwardly directed radial length greater than L whereby said protuberance passes under the bead of said cup when said lid is affixed to said cup and rotated with respect to said cup.

* * * * *